United States Patent [19]

Gaudino

[11] Patent Number: 4,598,540

[45] Date of Patent: Jul. 8, 1986

[54] RING SPINNING OR TWISTING MACHINE HAVING A DEVICE FOR THE AUTOMATIC AND SIMULTANEOUS REMOVAL OF ALL FULL COPS

[75] Inventor: Piero Gaudino, Cossato, Italy

[73] Assignee: Officine Gaudino di P. Gaudino & C. S. a.s., Cossato, Italy

[21] Appl. No.: 561,073

[22] Filed: Dec. 14, 1983

[30] Foreign Application Priority Data

Dec. 17, 1982 [IT] Italy ..... 68481 A/82

[51] Int. Cl.[4] ..... D01H 9/02; D01H 9/14; D01H 9/16; D01H 1/38

[52] U.S. Cl. ..... 57/278; 57/273; 57/276; 57/303; 242/18 EW

[58] Field of Search ..... 57/276–278, 57/303, 305, 306, 273–275; 242/18 EW, 18 PW

[56] References Cited

U.S. PATENT DOCUMENTS

| | | | |
|---|---|---|---|
| 2,582,696 | 1/1952 | Haythornthwaite | 57/273 |
| 3,210,922 | 10/1965 | Winter | 57/303 X |
| 3,339,356 | 9/1967 | Nikel et al. | 57/303 X |
| 3,491,526 | 1/1970 | Krauss et al. | 57/278 X |
| 3,530,657 | 9/1970 | Grau | 57/303 |
| 3,962,856 | 8/1976 | Weller et al. | 57/273 |
| 4,036,001 | 7/1977 | Tamai et al. | 57/274 |

FOREIGN PATENT DOCUMENTS

| | | |
|---|---|---|
| 101340 | 10/1896 | Fed. Rep. of Germany . |
| 700807 | 1/1931 | France . |
| 2327330 | 5/1977 | France . |
| 684700 | 12/1952 | United Kingdom . |
| 1137416 | 12/1968 | United Kingdom . |

*Primary Examiner*—John Petrakes
*Attorney, Agent, or Firm*—Barnes & Thornburg

[57] ABSTRACT

During the cop-forming phase of operation of a ring spinning or twisting machine, yarn is wound onto spools carried by the spindles in order to form cops. At the end of this phase, the yarn associated with each spindle is fastened below the spool by means of several fastening turns; thereafter, the full cops are removed with breakage of the yarns. In order to facilitate the operation of cop-removal means for automatically and simultaneously removing all of the full cops, yarn-severing means are provided that sever the yarns prior to the cop-removal means picking up the full cops. In a preferred embodiment, the yarn-separation means is arranged to snap the yarns by downwardly displacing the members around which the fastening turns are wound.

33 Claims, 10 Drawing Figures

RING SPINNING OR TWISTING MACHINE HAVING A DEVICE FOR THE AUTOMATIC AND SIMULTANEOUS REMOVAL OF ALL FULL COPS

The present invention relates to a ring spinning or twisting machine having a device for the automatic simultaneous removal of all the full cops.

Ring twisting or spinning machines are already known which are provided with automatic devices for simultaneously removing all the full cops from the spindles and discharging them from the machine. In these machines the cop spools on which the cops are formed are press fitted on to the tubular sections of so-called upper "sleeves" which are normally located on the spindles fast for rotation therewith and bear on annular, preferably frusto-conical, shoulders formed on the spindles.

An annular disc with peripheral toothing is fixed to the bottom of the tubular section of each upper sleeve and overlies a similar, adjacent annular disc which acts as the so-called lower "sleeve". This latter sleeve has the function of defining the upper limit of the zone in which the ring carrier platform occupies the so-called "under spool" position. The fastening turns are formed to enable the subsequent cop-forming process to be carried out, and these turns are needed to enable the initiation of the winding of the yarns on empty cop spools.

The devices or members which effect the simultaneous automatic removal of all the full cops, after stoppage of the spindles, are generally constituted by so-called take-up grippers, the number of which is the same as that of the spindles. These grippers are arranged to operate together to be lowered from above on to the full spindles, to raise the latter, and to transfer them to a conveyor which discharges the full spindles from the machine.

The same grippers, after having released the spindles deposited on the conveyor, are used to take up identical empty cop spools from the conveyor and fit them from above onto the spindles, and more precisely, on to the tubular sections of the upper sleeves that are engaged on the frusto-conical annular shoulders of the spindles themselves.

The grippers in question are preferably in the form of metal bushes provided internally with expandable annular sleeves arranged to clamp the upper parts of the full cops and hold them during the simultaneous raising of the bushes associated with the various spindles and cops formed on the latter.

The system described above, although having clear advantages over manual take-up of the full cops and their replacement by empty cop spools, is not free from serious disadvantages.

The simultaneous take-up of all the full cops from their respective spindles requires not only the raising of these cops but also the breaking of the yarns wound thereon from the fastened portions of these yarns. These fastened portions taking the form of a plurality of turns wound around the parts of the spindles underlying the upper sleeves. This requires the members carrying the take-up grippers to exert considerable additional force.

To this force is also added that needed to remove the upper sleeves from the annular shoulders formed on the spindles and to disengage the cop spools forming the cores of the cops from the tubular parts of the upper sleeves.

A further serious disadvantage of the known system lies in the fact that it does not lend itself to the achievement of automatic removal when the spindles of the spinning or twisting machines are provided with so-called spinning heads. Indeed in this case it is not possible to avoid breakage of the yarns fed to the rings during the descent of the grippers towards the cops to be taken up.

For this reason, in spinning machines equipped with spindles provided with spinning heads, the removal from and subsequent engagement on the spindles of the empty cop spools continues to be carried out by hand with an obvious loss of time and high production costs.

The object of the present invention is therefore to provide a spinning or twisting machine provided with a device for the simultaneous removal of all the full cops, which is free from the disadvantages mentioned above and which, in particular, lends itself to the automation of cop removal even in ring twisting or spinning machines whose spindles have so-called spinning heads at their upper ends.

According to the present invention these objects are achieved by the provision of a ring spinning or twisting machine having a device for the automatic simultaneous removal of all the full cops, characterised in that the separation of the portions of yarn wound on the cops from the "fastening" portions in the form of turns made when the ring-carrier platform occupies the so-called "under spool" position is effected by members separate from the said device for the automatic removal of the full cops, before the raising of the cops themselves by the removal device.

In a preferred embodiment of the method mentioned above, the fastening turns are formed on members rigid with the said lower sleeves surrounding the respective spindles, and the separation is effected by relative movement of the lower and upper sleeves. This relative movement includes the sequence of first raising both the upper and lower sleeves and then dropping both. The upper-sleeve does not fall below a given position, and the lower-sleeve continues to fall below this position. This particular sequence is shown in FIGS. 8, 9 and 10.

Moreover, according to the present invention, a ring spinning or twisting machine of the type specified above is provided in which the cop spools on which the cops are formed are press fitted onto tubular sections of the upper sleeves the sleeves are normally located on the spindles fast for rotation therewith and bear on annular, preferably frusto-conical, shoulders formed on these spindles. An annular disc with peripheral toothing is fixed to the lower part of each of these sections. The disc is located on a similar, adjacent annular disc, which acts as the lower sleeve delimiting the upper part of the zone in which the "fastening turns" are formed when the ring carrier platform is in the so-called "under spool" position. these turns are needed to enable the winding of the yarns on new cop spools that are still empty. Each of the lower sleeves also has a tubular part extending downwardly from its respective annular disc and is fitted onto the corresponding spindle. All of the lower sleeves are arranged to move simultaneously along their respective spindles under the action of members which are separate from the device arranged to remove the full cops from the spindles and to discharge them from the machine. First, these members are driven to lower the lower sleeves and move them a substantial distance from the upper sleeves which occupy their normal positions, and then to raise the lower sleeves upwardly, and finally to return them to their starting positions.

According to a further preferred embodiment of the invention, in the case in which the spindles of the spinning or twisting machine are provided with so-called spinning heads, the upward displacement of the lower sleeves is such as to bring the upper sleeves and therewith the full cops, to a level at which the tops of the corresponding cop spools are higher than the free ends of the spinning heads. This upper displacement can occur prior to yarn severance.

Other characteristics and advantages of the invention will emerge from the description which follows with reference, by way of a non-limiting example, to a practical embodiment illustrated in the appended drawings, in which:

FIG. 1 is a perspective view showing several details of the spinning machine according to the invention, FIGS. 2, 3 and 4 are partially-sectioned side elevational views showing one of the spindles of a spinning or twisting machine according to the invention respectively: during the formation of the fastening turns at the end of the cop-forming process, during the stage of separating the yarn wound on the cop from the fastening turns and, during the stage immediately preceding the take-up of the full cop by the automatic removal device, FIG. 5 is a section taken on line V—V of FIG. 3, FIG. 6 is a view similar to that of FIGS. 2 to 4, showing the members for effecting the vertical displacement of the upper and lower ring nuts.

Figure 1:
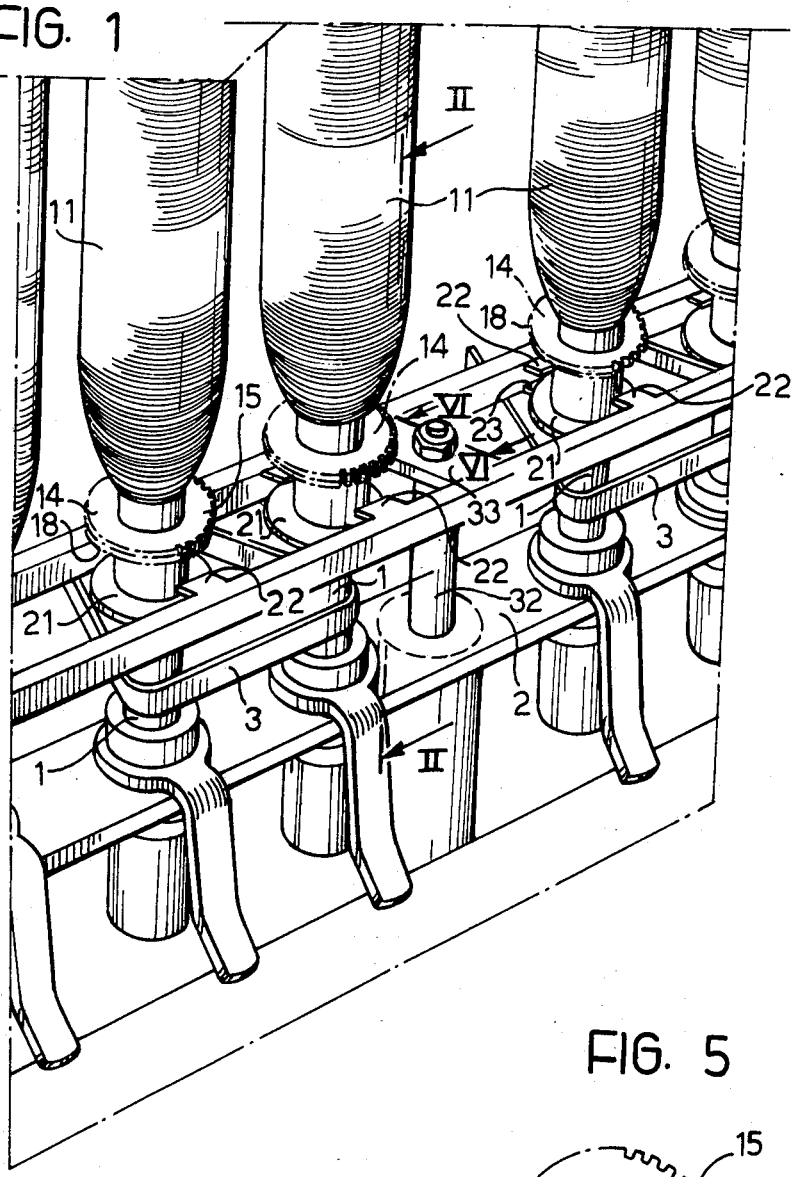

In the drawings, which show several details of a ring type spinning machine, the lower parts of the spindles indicated 1, are supported by an angle-section table 2 which extends along the entire front of the machine. Each of the spindles, which is driven in known manner by means of a belt 3 has an upper, smaller-diameter part 4. This is connected to the part 1 by means of an annular frusto-conical shoulder 5.

Attached to the top of the part 4 is the so-called spinning head 6. This has an approximately helically-shaped end 7 which is engaged by the yarn 8 that comes from drafting rollers 9 (see FIG. 2) and passes through a removable eye 10 which is located on the axis of the spindle above the corresponding spinning head.

Figure 5:
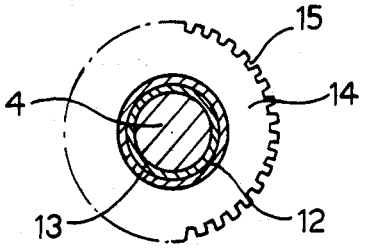
Figure 4:
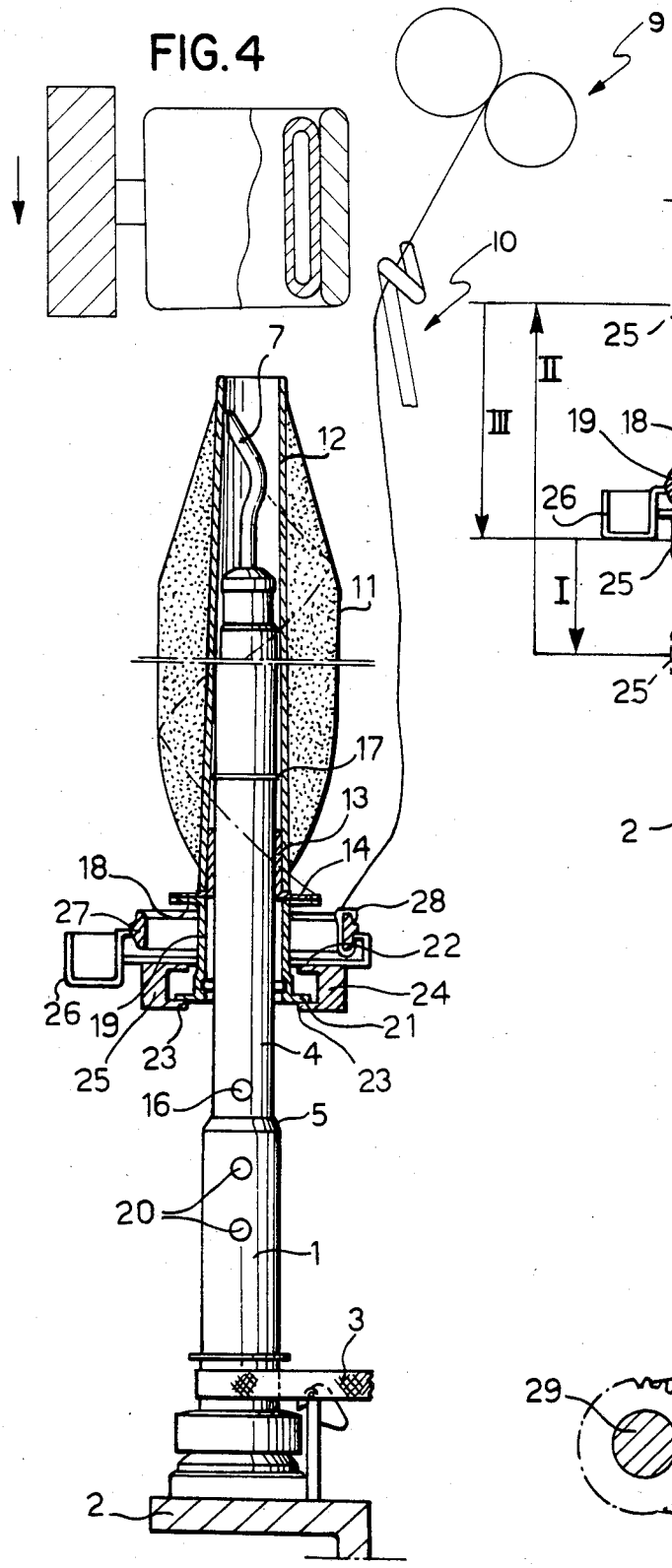

The cop 11 is formed by yarn wound on the cop spool 12 having the lower part press fitted on to the tubular section 13 of the so-called upper sleeve. The sleeve is provided with a lower annular flange 14 having peripheral toothing 15 (see FIG. 5). The lower part of the sleeve 13, 14 has an internal frusto-conical seat which bears on the frusto-conical shoulder 5 separating the parts 1 and 4 of the spindle. Under these conditions it is fast for rotation with spindle by virtue of its frictional engagement with a block 16 of resilient material inserted in a hole formed in the part 4 of the spindle a small distance from the frusto-conical shoulder 5. The upper sleeve 13, 14 is also axially movable along the spindle between the said annular shoulder 5 and a stop constituted by an expandable ring 17 (see FIG. 4) seated in an annular peripheral groove formed in the part 4 of the spindle a small distance from the corresponding spinning head 6. Below the annular disc 14 of the upper sleeve is a similar top annular disc 18 belonging to the lower sleeve. This disc is rigid with a tubular bush 19 fitted on to, and axially slidable along, the part 1 of the spindle. The bush 19 is prevented from rotating relative to the part 1 by virtue of the presence of blocks 20 similar to the block 16 described above. The lower end of the bush 19 also has a bottom annular disc 21 the diametrally opposed parts of which are located between pairs of upper lugs 22 and lower lugs 23 respectively carried by longitudinal bars 24 and 25 which extend parallel to the row of spindles on opposite sides of the row itself.

Reference 26 indicates the platform for the rings 27 each of which has a traveller 28 through which passes the yarn 8 coming from the spinning head 6 during the winding of the cops 11, or directly from the eye 10 during the removal of the cop itself.

Figure 2:
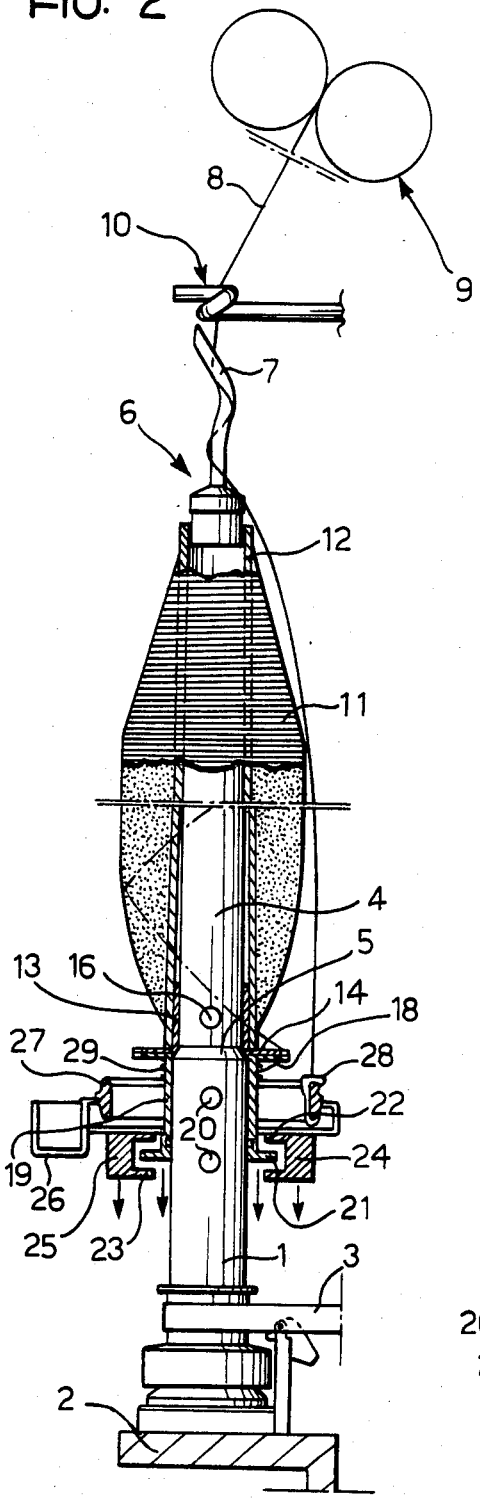

The bars 24 and 25 are guided and controlled so as to be movable vertically, in the example illustrated in the drawings, under the command of a mechanism including a longitudinal shaft 29 (see FIG. 6) acting via transmissions 30, on a plurality of lead screws 31 cooperating with sleeves 32. The tops of the sleeves 32 are fixed to the bars 24 and 25 by means of cross members 33. The operation of this mechanism is synchronised with that which controls the spinning machine and the associated device 34 for the automatic removal of the full cops and for their replacement by empty cop spools so as to achieve the following sequence of operations:

Upon the triggering of automatic descent which starts when the cops are fully formed, the ring carrier platform 26 is lowered and brought into the so-called "under spool" position, illustrated in FIG. 2, that is beneath the zone in which the parts 14 and 18 respectively of the upper and lower sleeves meet.

With the platform 26 in this position, the spindle 1, 4 is allowed to rotate for a predetermined time so as to enable, through the ring 27 and the traveller 28, several fastening turns 29 of yarn to be wound on the tubular part 29 of the lower sleeve. The lower sleeve is held firm on the part 1 of the spindle by the action of the blocks 20.

After this has been done, the spindle 1, 4 is stopped and the yarn is severed between the yarn wound on the cop 11 and the turns wound on the bush 19 forming part of the lower sleeve.

Figure 3:
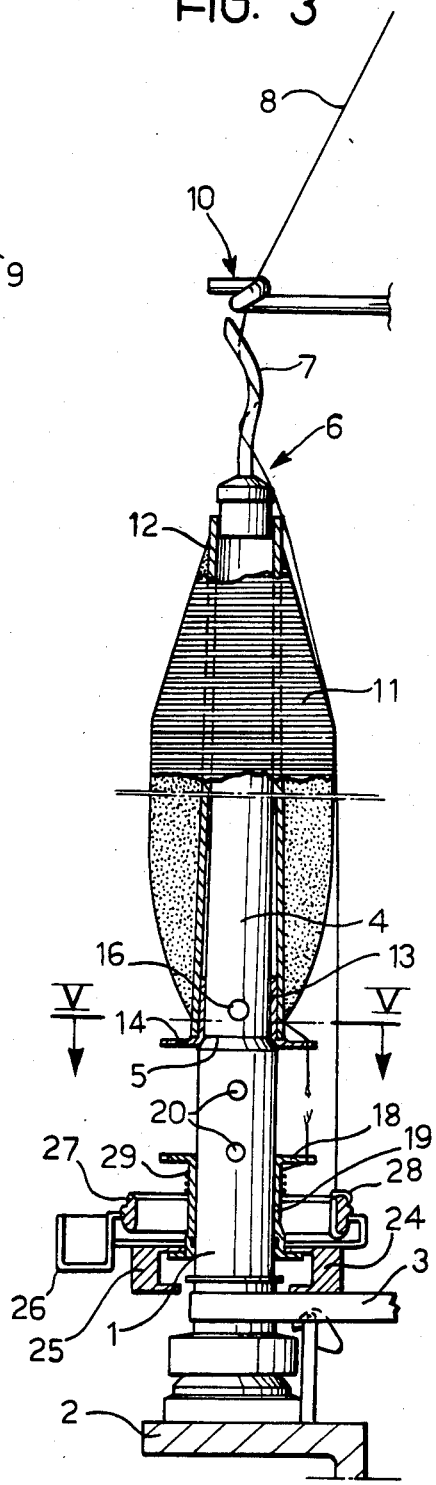
Figure 6:
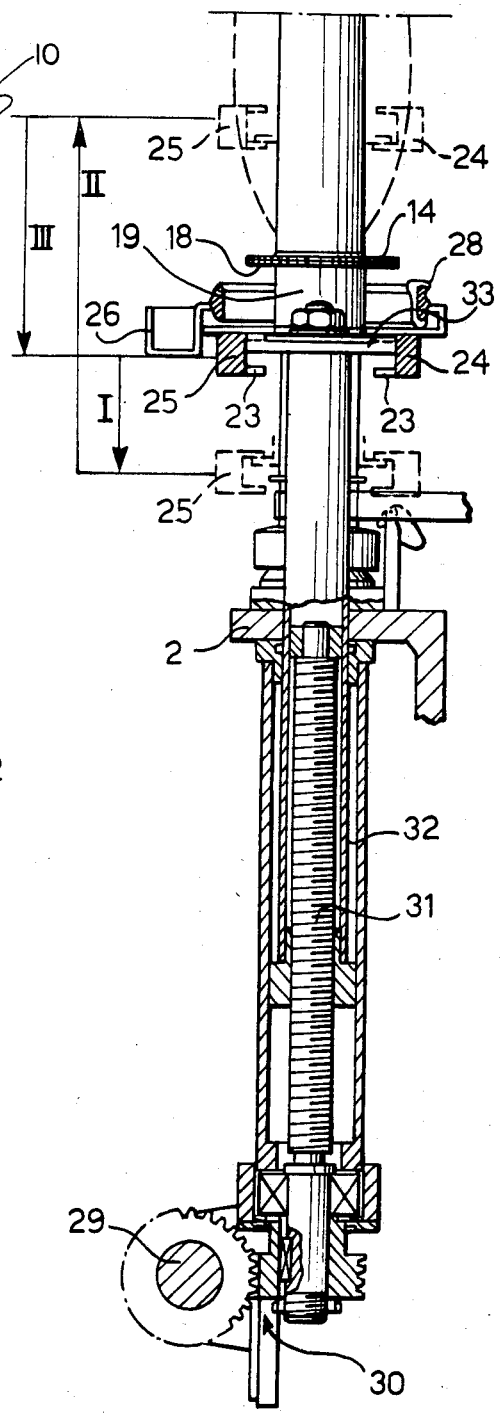

For this purpose, an actuator is operated which, through the drives illustrated in FIG. 6, lowers the bars 24 and 25 until the associated upper lugs 22 engage the bottom annular disc 21 of the lower sleeve and move the latter downwardly to the position illustrated in FIG. 3.

The amplitude of this displacement is such as to bring the top annular disc 18 of the lower sleeve to a distance from the annular disc 14 of the upper sleeve sufficient to cause breakage of the yarn 8 by snapping. Slipping of the yarn relative to the upper and lower sleeves is prevented by virtue of its engagement in the peripheral teeth of their corresponding annular parts 14 and 18.

At this point, the disengagement of the portion of the yarn wound on the cop 11 from that connected through the traveller 28 and the eye 10 to the drafting rollers 9 is complete, and the lower sleeves 18, 19 21 is moved upward. This movement is continued until the cop 11 is no longer engaged on the shoulder 5 of the corresponding spindle so as to alleviate the take-up members 34 intended to take up the cops, not only of the force needed to carry out the snapping of the various yarns but also of that needed to remove the cops from the shoulders 5.

This operation is carried out by raising the bars 24 and 25 by means of the mechanism including the shaft 29 and the members 30–33 (see FIG. 6). The lower lugs 23 of these bars act on the lower annular disc 21 of the lower sleeve and cause sleeve to rise first to the position in which the top annular disk 18 of the lower sleeve re-establishes contact with the annular disc 14 of the upper sleeve. After having been lifted from the shoulders 5, the upper sleeve brings the top of the corresponding cop spool 12 to a level above that occupied by the free end of the spinning head 6.

This automatically causes the disengagement of the yarn 8 leaving the drafting roller 9 from the spinning head 6 of the spindle and make it possible for the take-up members of the automatic removal device to grasp and remove the cops.

When the spinning or twisting machines are of the type in which the spindles are not provided with spinning heads, the upper sleeves obviously do not need to have such a large displacement. In this case it will be sufficient for the upper sleeves 13, 14 to be lifted up to an extent sufficient to remove them from the frusto-conical shoulders 5 of the spindles 1, 4.

Figure 8:
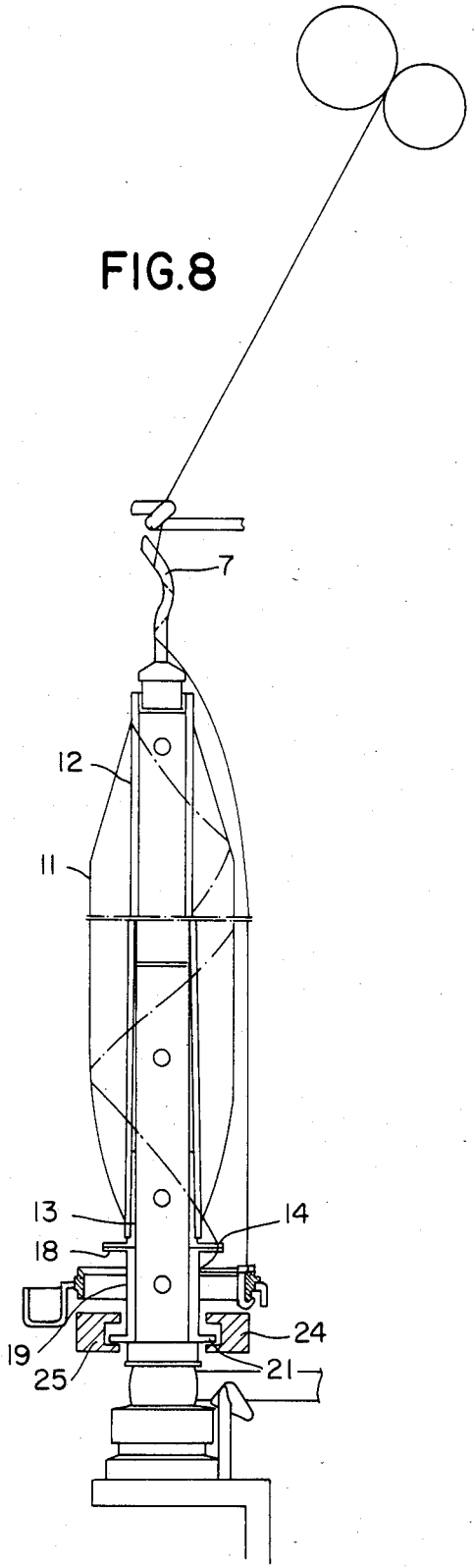
FIGS. 8, 9 and 10 are views of the sequence of one method.
Figure 9:
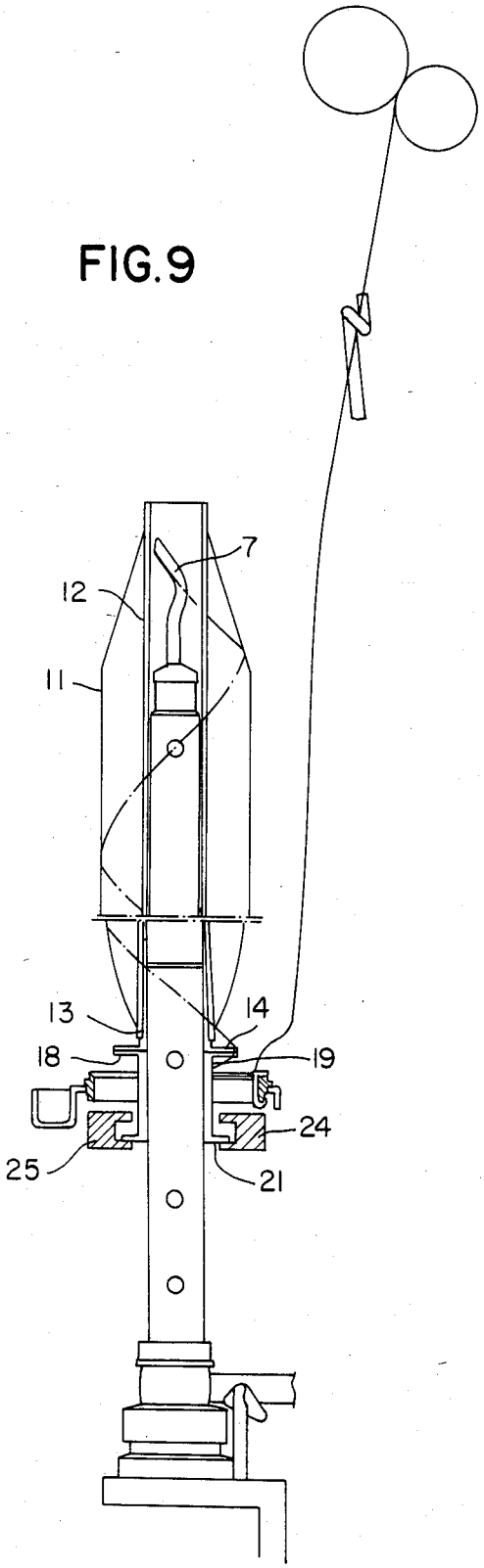
Figure 10:
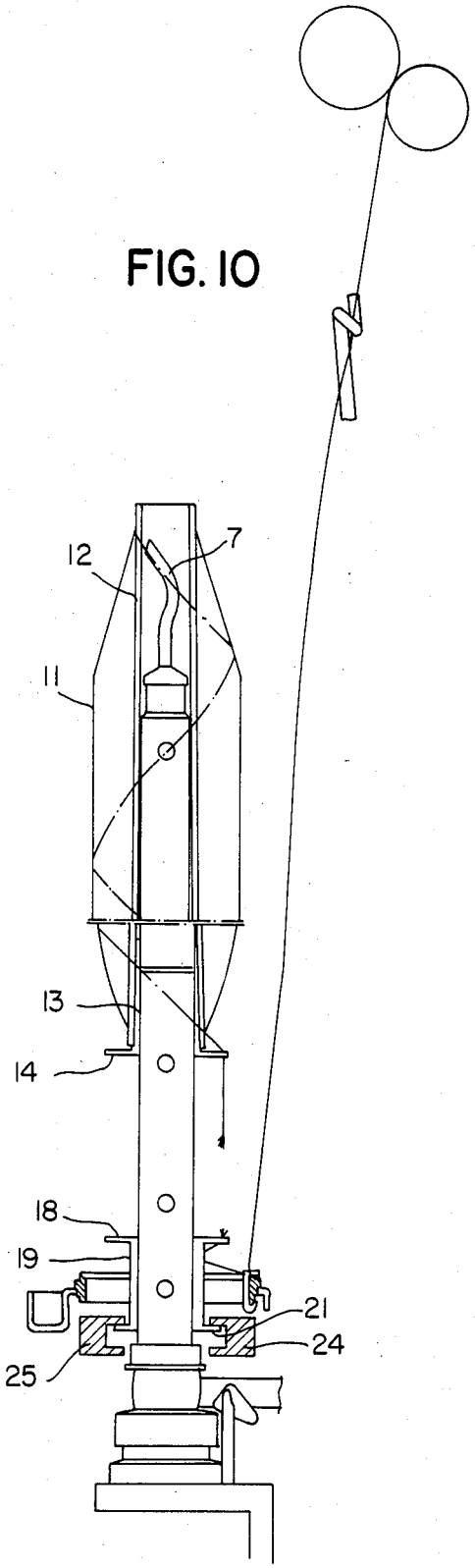

The sequence and amplitude of the movements imposed in the latter case on the bars 24 and 25 is indicated by the arrows I, II and III respectively given in FIG. 6. FIGS. 8, 9, 10 show another sequence for the method.

Naturally, the principle of the invention remaining the same its details may be varied widely with respect to those described and illustrated purely by way of example, without thereby departing from the scope of the invention defined in the appended claims.

Figure 7:
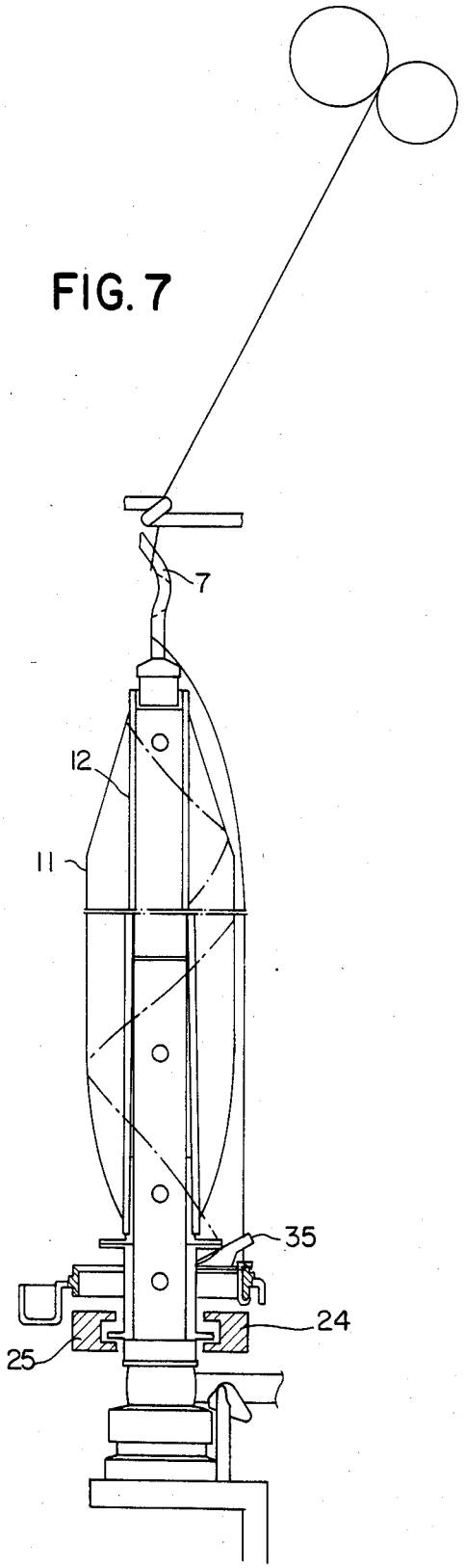
FIG. 7 is a view of the heat-emitting severing means.

Thus for example the bars 24, 25 which cause the vertical movements of the lower ring nuts may be driven by one or more pneumatic or hydraulic actuators or by a linear magnetic motor. In addition, the yarn severing means may cause mutual relative rotation of the upper and lower sleeves for severance. Also, the yarn, severing means may be a heat-emitting element 35 such as an incondescent electrical resistance arranged to burn through the yarn (as shown in FIG. 7).

However for each case the essential condition satisfied is that the snapping of the yarns 8 is positively guaranteed by the time the take-up members grasp the full cops. This avoids the very serious disadvantage of the known systems which lies in the unwinding of the turns that cover the cops and are formed at the moment of descent of the platform, and/or the unwinding of the "under spool" turns. A disadvantage which would prejudice the possibility of placing the cops on the support pins of the conveyor belt with consequent stoppage of the automatic removal process.

The raising of the cops above the spinning heads, as well as considerably facilitating the removal of the cops by means of the so-called take-up grippers or members, also gives rise to a further advantage in terms of the proper operation of the automatic removal process.

The assured removal of the turns from the spinning heads 6 located at the tops of the spindles (these turns having been formed during the normal technological spinning process), prevents any breakage and damage to the ends of the starting yarns for the succeeding cops, thereby eliminating long, complex and costly manual operations which are otherwise necessary for restarting the automatic operation of the machine.

As a result of the cops being raised above the spinning heads of the spindles, the said turns in fact unwind automatically and free the cops for grasping by the take-up members and transfer to the conveyor which discharge them from the machine.

The fact that the raising of the cops is effected by action taken below the so-called "under spool" zone, also allows the pinching of the starting yarns and their breakage and damage to be prevented.

I claim:

1. A ring spinning machine comprising:

at least one spindle for receiving a cop spool upon which yarn is formed;

a cop removal device means having grippers for removing cop spools with yarn formed thereon;

cop raising means for raising the cops to a position to accommodate removal of the cop spools by the cop removal device means;

and a yarn severing means for severing the last formed section of yarn to accommodate removal of the cop spools by the cop removal device means, wherein said yarn severing means includes means operable prior to and separately from the operation of the cop removal means.

2. A ring spinning machine as in claim 1, including a ring disposed on a ring platform, wherein said ring platform occupies a cop forming position for winding yarn onto a cop spool and occupies an underspool position for yarn severance.

3. A ring spinning machine as in claim 2, including:

an upper sleeve received on said spindle, said sleeve having a top and bottom end, said sleeve engaging a cop spool placed on said spindle, wherein said upper sleeve has a fixed position from which it can only be raised, and a lower sleeve received on said spindle, said sleeve having a top and bottom end, wherein said lower sleeve has windings of yarn secured thereto for yarn severance.

4. A ring spinning machine as in claim 3, including a shoulder on said spindle for supporting said upper sleeve, wherein said shoulder prevents said upper sleeve from dropping below said fixed position.

5. A spinning machine as in claim 4, wherein said severing means forces relative rotation of said upper and lower sleeves for yarn severance.

6. A spinning machine as in claim 4, wherein said severing means comprises a heat-emitting element which burns through the yarn between the cop spool and the yarn windings on said lower sleeve.

7. A spinning machine as in claim 6, wherein said heat-emitting element is an incandescent electrical resistance.

8. A ring spinning machine as in claim 3, wherein the severing means lowers the lower sleeve while the upper sleeve is in said fixed position thereby severing the yarn.

9. A ring spinning machine as in claim 8, wherein the upper sleeve has a tubular section surrounding the spindle and an integral annular disc on the bottom of said tubular section, said lower sleeve has a tubular section surrounding the spindle, an integral top annular disc on the top end of said lower sleeve, and an integral bottom annular disc on the bottom end of said lower sleeve.

10. A ring spinning machine as in claim 9, wherein said annular disc of said upper sleeve and said top annular disc of said lower disc have teeth for holding said yarn.

11. A ring spinning machine as in claim 10, wherein the severing means comprises two bars on opposite sides of said spindle, said bars having upper and lower lugs, in between which is disposed said bottom annular disc of said lower sleeve, wherein said lugs engage said lower sleeve for raising and lowering said sleeve.

12. A ring spinning machine as in claim 11, wherein the operation of the severing means is automatic.

13. A ring spinning machine as in claim 12, wherein there is a row of spindles and said severing means is a bar which engages all lower sleeves of said spindles.

14. A ring spinning machine as in claim 13, including driving means for raising and lowering said severing means.

15. A ring spinning machine as in claim 1, including a spinning head attached to a top end of said spindle for receiving yarn in the cop forming process.

16. A ring spinning machine as in claim 15, wherein said spinning head is free of yarn prior to cop removal.

17. A ring spinning machine as in claim 16, wherein the severing means raises the lower sleeve into the upper sleeve thereby forcing the cop spool upward to disengage yarn from said spinning head prior to cop removal.

18. A ring spinning machine as in claim 16, wherein the severing means and the raising means are the same device.

19. A spinning machine process comprising:

spinning yarn on a cop spool received on a spindle by a ring disposed on a ring platform surrounding the spindle, said platform being movable along said spindle;

raising the cop spools with a raising means, said raising means including an upper sleeve surrounding said spindle for receiving a spool, said sleeve being movable from a bottom fixed position upward to lift said cop spool upward and wherein said spindle has a lower sleeve surrounding said spindle wherein said lower sleeve is movable above and below said upper sleeve fixed position;

severing the yarn with severing means;

removing cop spools with a cop removal means independent and subsequent to yarn severance.

20. Process according to claim 19, wherein the ring platform drops to an under spool position and spins an underspool yarn attachment to said lower sleeve surrounding said spindle.

21. Process according to claim 20, wherein the severing means raises the lower sleeve which forces the upper sleeve upward and thereby raises the cop spool above the top of the spinning head to disengage the yarn from said spinning head prior to severance of the yarn, drops the sleeves so that the lower sleeve falls below the upper sleeve fixed position to sever the yarn between the underspool attached yarn and the cop spool prior to removal of the cop spools.

22. Process according to claim 21, wherein said upper sleeve has a tubular section having an integral annular disc on a lower end of said sleeve, and said lower sleeve has a tubular section having an integral top annular disc and a bottom annular disc on the upper and lower ends respectively of said tubular section.

23. Process according to claim 22, wherein said severing means comprises two bars on opposite sides of said spindle, said bars having upper and lower lugs in between which is disposed said bottom annular disc of said lower sleeve, wherein said lugs engage said lower sleeve for raising and lowering said sleeve.

24. Process according to claim 22, wherein the severing process is automatic.

25. Process according to claim 20, wherein the raising means and the severing means are the same device.

26. A spinning machine process comprising:

spinning yarn on a cop spool received on a spindle;

severing the yarn with a severing means;

raising the cop spools with a raising means to a position to accommodate removal of the cop spools by a cop removal device means, said cop removal device means having grippers, removing cop spools with the cop removal means independent and subsequent to yarn severance.

27. Process according to claim 26, wherein the yarn is spun onto a cop spool by a ring disposed on a ring platform surrounding the spindle, said platform being movable along said spindle.

28. Process according to claim 27, wherein said spindle has an upper sleeve surrounding said spindle for receiving a spool, said sleeve is movable from a bottom fixed position upward to lift said cop spool upward and wherein said spindle has a lower sleeve surrounding said spindles wherein said lower sleeve is movable above and below said upper sleeve fixed position.

29. Process according to claim 28, wherein the ring platform drops to an under spool position and spins an underspool yarn attachment to said lower sleeve surrounding said spindle.

30. Process according to claim 29, wherein the severing means raises the lower sleeve which forces the upper sleeve upward and thereby raises the cop spool above the top of a spinning head to disengage the yarn from said spinning head, said severing means subsequently raising the cop spool into engagement with said cop removal means.

31. Process according to claim 30, wherein said upper sleeve has a tubular section having an integral annular disc on a lower end of said sleeve, and said lower sleeve has a tubular section having an integral top annular disc and a bottom annular disc on the upper and lower ends respectively of said tubular section.

32. Process according to claim 31, wherein said severing means comprises two bars on opposite sides of said spindle, said bars having upper and lower lugs in between which is disposed said bottom annular disc of said lower sleeve, wherein said lugs engage said lower sleeve for raising and lowering said sleeve.

33. Process according to claim 32, wherein the severing process is automatic.

* * * * *